US008063570B2

(12) United States Patent
Zhang et al.

(10) Patent No.: US 8,063,570 B2
(45) Date of Patent: Nov. 22, 2011

(54) SIMPLE PROTECTION CIRCUIT AND ADAPTIVE FREQUENCY SWEEPING METHOD FOR CCFL INVERTER

(75) Inventors: Junming Zhang, Hanzhou (CN); Yuancheng Ren, Hangzhou (CN); Kaiwei Yao, Santa Clara, CA (US); Eric Yang, Saratoga, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 454 days.

(21) Appl. No.: 12/166,140

(22) Filed: Jul. 1, 2008

(65) Prior Publication Data

US 2009/0140655 A1 Jun. 4, 2009

(30) Foreign Application Priority Data

Nov. 29, 2007 (CN) ..... 2007 1 0193990

(51) Int. Cl.
*H05B 37/02* (2006.01)
*H05B 41/36* (2006.01)

(52) U.S. Cl. ..... 315/224; 315/308

(58) Field of Classification Search ..... 315/224, 315/225, 306, 308, 312, 209 R
See application file for complete search history.

(56) References Cited

U.S. PATENT DOCUMENTS 4,855,888 A 8/1989 Henze et al.
4,885,477 A 12/1989 Bird et al.
5,144,117 A 9/1992 Hasegawa et al.
5,341,266 A 8/1994 Grove et al.
5,502,819 A 3/1996 Aldrich et al.
5,528,192 A 6/1996 Agiman et al.
5,601,509 A 2/1997 Munoz
5,601,940 A 2/1997 Denecke
5,615,093 A 3/1997 Nalbant
5,619,402 A 4/1997 Liu
5,636,111 A 6/1997 Griffin et al.
5,705,717 A 1/1998 Puy et al.
5,757,173 A 5/1998 Agiman
5,809,233 A 9/1998 Shur
5,892,336 A 4/1999 Lin et al.
5,902,312 A 5/1999 Frater et al.
5,903,012 A 5/1999 Boerstler
5,923,129 A 7/1999 Henry
5,929,621 A 7/1999 Angelici et al.
5,930,121 A 7/1999 Henry
5,930,126 A 7/1999 Griffin et al.
6,100,414 A 8/2000 Li et al.
6,104,146 A 8/2000 Chou et al.
6,109,823 A 8/2000 Halferty et al.
6,109,824 A 8/2000 Annes et al.
6,111,732 A 8/2000 Beland et al.
6,118,415 A 9/2000 Olson
6,198,234 B1 3/2001 Henry
6,198,245 B1 3/2001 Du et al.
6,205,961 B1 3/2001 Bailey et al.
6,218,788 B1 4/2001 Chen et al.
6,259,615 B1 7/2001 Lin
6,300,776 B1 10/2001 Schreiber et al.
(Continued)

*Primary Examiner* — Douglas W Owens
*Assistant Examiner* — Minh D A
(74) *Attorney, Agent, or Firm* — Perkins Coie LLP

(57) ABSTRACT

A CCFL inverter circuit integrates a feedback circuit and protection circuit together. For both in-phase and out-of-phase applications, sensed lamp voltages can be used for open lamp and short lamp detection and sensed currents can be used for open lamp detection. The driving circuit adjusts the open lamp frequency by using a duty cycle control signal so that the driving circuit can always achieve the desired lamp voltage gain.

22 Claims, 9 Drawing Sheets

U.S. PATENT DOCUMENTS 6,307,765 B1 10/2001 Choi
6,309,672 B1 10/2001 Bae et al.
6,396,722 B2 5/2002 Lin
6,405,960 B2 6/2002 Yano et al.
6,406,992 B1 6/2002 Mao et al.
6,459,602 B1 10/2002 Lipcsei
6,469,922 B2 10/2002 Choi
6,500,123 B1 12/2002 Holloway et al.
6,500,717 B2 12/2002 Goodwin et al.
6,501,234 B2 12/2002 Lin et al.
6,501,588 B1 12/2002 Rosa et al.
6,503,183 B1 1/2003 Bennish, Jr. et al.
6,505,960 B2 1/2003 Schubert et al.
6,507,034 B1 1/2003 Nakasugi et al.
6,507,173 B1 1/2003 Spiridon et al.
6,515,881 B2 2/2003 Chou et al.
6,531,831 B2 3/2003 Chou et al.
6,559,606 B1 5/2003 Chou et al.
6,570,344 B2 5/2003 Lin
6,605,426 B1 8/2003 Goldmakher et al.
6,605,727 B2 8/2003 Wood et al.
6,654,268 B2 11/2003 Choi
6,657,274 B2 12/2003 Comeau et al.
6,705,676 B1 3/2004 Berringer et al.
6,707,264 B2 3/2004 Lin et al.
6,708,132 B1 3/2004 Gutierrez et al.
6,710,555 B1 3/2004 Terada et al.
6,756,769 B2 6/2004 Bucur et al.
6,781,325 B2 8/2004 Lee et al.
6,800,993 B2 10/2004 Tho et al.
6,804,129 B2 10/2004 Lin
6,805,304 B1 10/2004 Nokes et al.
6,805,651 B2 10/2004 Lipman et al.
6,806,466 B2 10/2004 Guevremont et al.
6,807,033 B2 10/2004 Zhu
6,807,332 B1 10/2004 Hawwa
6,807,615 B1 10/2004 Wong et al.
6,808,833 B2 10/2004 Johnson
6,809,769 B1 10/2004 Yang
6,809,938 B2 10/2004 Lin et al.
6,853,047 B1 2/2005 Comeau et al.
6,856,519 B2 2/2005 Lin et al.
6,864,669 B1 3/2005 Bucur
6,870,330 B2 3/2005 Choi
6,873,322 B2 3/2005 Hartular
6,876,157 B2 4/2005 Henry
6,888,338 B1 5/2005 Popescu-Stanesti et al.
6,897,698 B1 5/2005 Gheorghiu et al.
6,900,099 B2 5/2005 Huang et al.
6,900,649 B1 5/2005 Knauer
6,900,993 B2 5/2005 Lin et al.
6,903,697 B2 6/2005 Ogino et al.
6,904,680 B2 6/2005 Fidziukiewicz
6,906,497 B2 6/2005 Bucur et al.
6,907,995 B1 6/2005 Tahkanen
6,909,932 B2 6/2005 Haschke et al.
6,927,989 B2 8/2005 Fukumoto et al.
6,936,975 B2 8/2005 Lin et al.
6,946,806 B1 9/2005 Choi
6,979,959 B2 12/2005 Henry
6,999,328 B2 2/2006 Lin
7,002,370 B1 2/2006 Metzgen et al.
7,005,761 B2 2/2006 Deboy et al.
7,006,118 B2 2/2006 Araki et al.
7,007,524 B2 3/2006 Jasper
7,009,539 B2 3/2006 Okuda et al.
7,023,709 B2 4/2006 Lipcsei et al.
7,034,542 B2 4/2006 Peterson
7,057,450 B2 6/2006 Koike et al.
7,057,611 B2 6/2006 Lin et al.
7,061,183 B1 6/2006 Ball
7,075,245 B2 7/2006 Liu
7,075,251 B2 7/2006 Chen et al.
7,095,183 B2 8/2006 Alexandrov
7,095,392 B2 8/2006 Lin
7,101,292 B2 9/2006 Ohama et al.
7,101,294 B2 9/2006 Tucker, Sr.
7,102,003 B2 9/2006 Gavai et al.
7,102,628 B2 9/2006 LeKuch et al.
7,104,193 B2 9/2006 Adamczyk et al.
7,105,788 B2 9/2006 Hopkins
7,106,130 B2 9/2006 Gan et al.
7,107,338 B1 9/2006 Nareddy et al.
7,108,372 B2 9/2006 Li et al.
7,108,713 B1 9/2006 Augustine
7,108,714 B1 9/2006 Becker
7,109,012 B2 9/2006 Takenawa et al.
7,109,665 B2 9/2006 Green
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,154,232 B2 12/2006 Contenti et al.
7,157,886 B2 1/2007 Agarwal et al.
7,161,309 B2 1/2007 Chiou et al.
7,173,382 B2 2/2007 Ball
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee et al.
7,200,001 B2 4/2007 Spychalla
7,200,017 B2 4/2007 Lin
7,204,214 B2 4/2007 Miyaji et al.
7,204,824 B2 4/2007 Moulis
7,205,072 B2 4/2007 Kang et al.
7,205,073 B2 4/2007 Kim et al.
7,205,356 B2 4/2007 Gurtler et al.
7,207,985 B2 4/2007 Duong et al.
7,227,316 B2 6/2007 Lu et al.
7,242,147 B2 7/2007 Jin
7,248,240 B2 7/2007 Lin et al.
7,250,726 B2 7/2007 Ball
7,250,731 B2 7/2007 Jin
7,253,569 B2 8/2007 Liu
7,265,497 B2 9/2007 Chen et al.
7,279,851 B2 10/2007 Ball
7,372,213 B2 5/2008 Kuo et al.
7,391,167 B2 6/2008 Jang et al.
7,394,203 B2 * 7/2008 Ren et al. ..... 315/129
7,394,209 B2 7/2008 Lin et al.
7,417,382 B2 8/2008 Lin
7,420,337 B2 * 9/2008 Ren et al. ..... 315/308
7,423,384 B2 * 9/2008 Ren et al. ..... 315/224
7,560,879 B2 * 7/2009 Chen ..... 315/308
2002/0180380 A1 12/2002 Lin
2005/0151716 A1 7/2005 Lin
2006/0049773 A1 3/2006 Moyer et al.
2006/0158136 A1 7/2006 Chen
2006/0202635 A1 9/2006 Liu
2006/0232222 A1 10/2006 Liu et al.
2006/0279521 A1 12/2006 Lin
2007/0047276 A1 3/2007 Lin et al.
2007/0247085 A1 10/2007 Yao et al.
2007/0285033 A1 12/2007 Chen et al.
2008/0158760 A1 7/2008 Moyer et al.

* cited by examiner

SIMPLE PROTECTION CIRCUIT AND ADAPTIVE FREQUENCY SWEEPING METHOD FOR CCFL INVERTER

CROSS-REFERENCE TO RELATED APPLICATION

The present application claims the benefit of previously filed Chinese Patent Application No. 200710193990.5 filed on Nov. 29, 2007 under 35 U.S.C. §119.

TECHNICAL FIELD

The present invention relates to the driving of one or more fluorescent lamps, and more particularly, to an open lamp and short lamp protection circuit and adaptive frequency sweeping method for a cold cathode fluorescent lamp (CCFL).

BACKGROUND

Lamp current regulation at normal operation and lamp voltage regulation at open lamp condition is a function that is implemented by a CCFL inverter. Furthermore, the CCFL inverter should implement short circuit protection and open lamp voltage protection.

Typically, the winding current (or lamp current) is sensed for open lamp protection and lamp current feedback. The lamp voltage may also be sensed for short circuit protection and lamp voltage regulation during an open lamp condition. Generally, the feedback circuit and the protection circuit cannot be integrated together due to their differing requirements. For example, the lamp voltage feedback needs the maximum value of the sensed lamp voltage, and the short circuit protection circuit needs the minimum value of the sensed lamp voltage for proper detection. Therefore, four separate sets of circuits for the feedback and protection circuit are required. This requires significant external circuitry and makes for a complex circuit structure. Furthermore, the circuits are even more complex for out-of-phase applications, which are popular in current CCFL inverter systems.

A CCFL exhibits large impedance if current is not applied and smaller impedance once the lamp is ignited. Therefore, during startup period or open lamp condition, the lamp voltage should be regulated to a high value to ignite the lamp. Due to inherent characteristics of the series-parallel resonance of the circuit, the switching frequency at that time should be set to a higher value than during normal operation. In a conventional CCFL inverter, the frequency hop method is usually used. Some controllers provide separate pins to set the normal operation frequency and open lamp frequency respectively. Other controllers simply set the open lamp frequency to a certain ratio of the normal operation frequency internally. Some controllers use external circuitry to implement this function. These methods are usually complex or require an extra pin for the controller. Though the internal frequency hop method is simple, it is not flexible for varying loads. At certain load conditions, it may cause instability of the CCFL inverter.

BRIEF DESCRIPTION OF THE DRAWINGS

FIG. 5(*b*) illustrates a waveform of the output of the short circuit protection circuit of FIG. 5(*a*).

DETAILED DESCRIPTION

Figure 1:
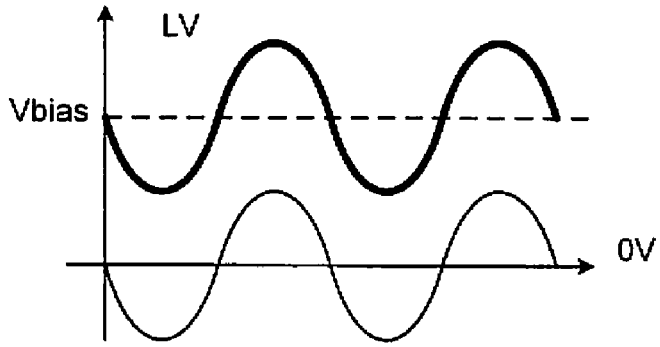
FIG. 1 illustrates a waveform of the sensed lamp voltage signal LV with and without DC bias.

In a typical prior art circuit, only a half cycle of the lamp voltage can be used for sensing. In order to combine the feedback circuit and protection circuit, a DC bias voltage is added to the sensed lamp voltage LV. See FIG. 1. The positive half cycle is used for open lamp voltage regulation with an OR logic circuit. The negative half cycle is used for short circuit protection.

Figure 2:
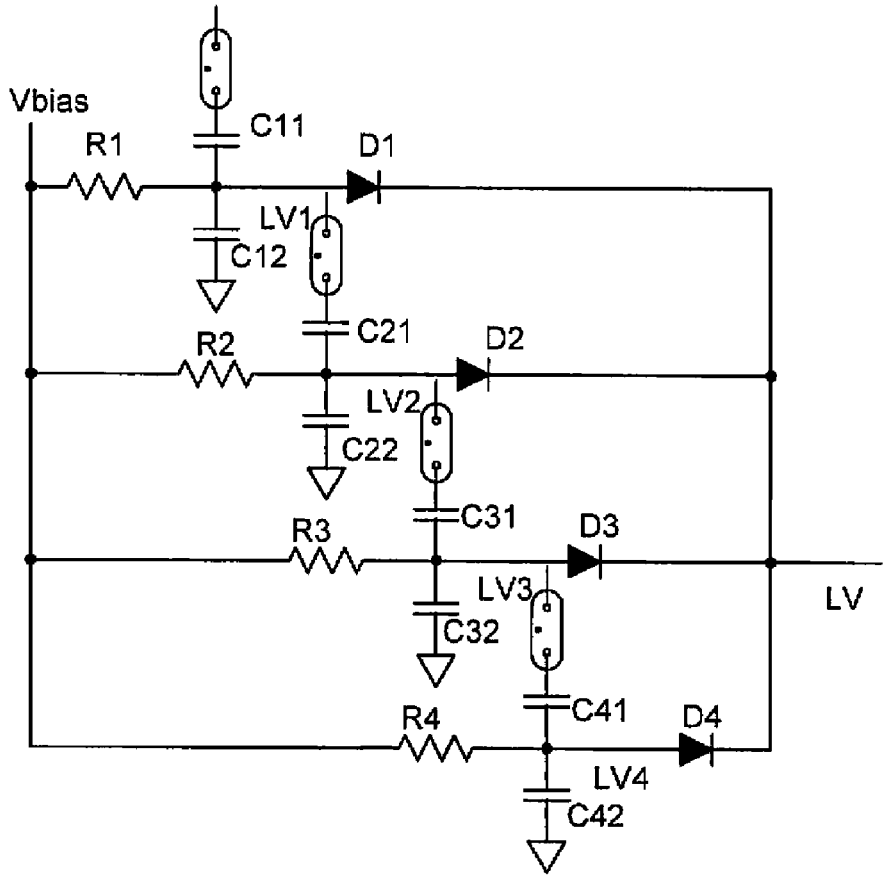
FIG. 2 is a schematic drawing of the LV signal detecting circuit for a 4-lamp in-phase application in accordance with the present invention.

A lamp voltage (LV) signal detecting circuit according to one aspect of the present invention is shown in FIG. 2. A 4-lamp in-phase application is used as an example to describe the detailed concept. LV1, LV2, LV3 and LV4 are the sensed lamp voltages, which are all in phase. Four diodes are needed to form an OR logic gate. In general, N diodes are needed for an N-lamp application.

Figure 3:
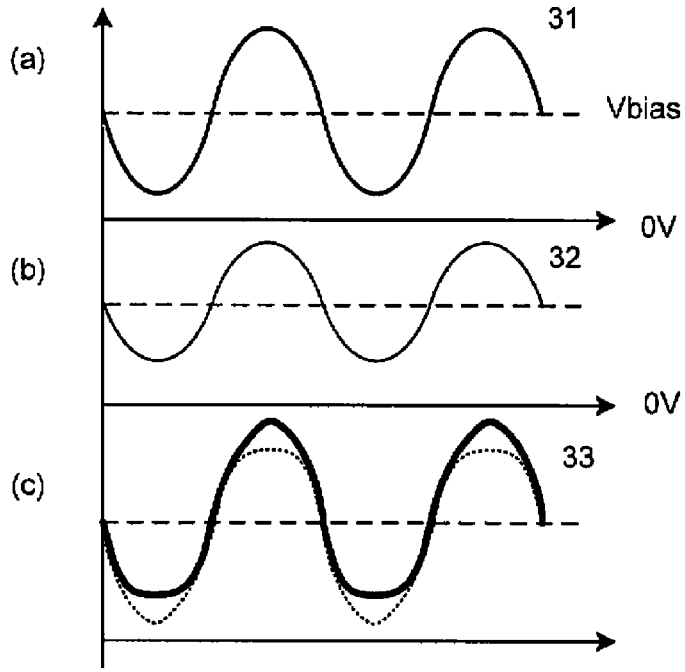
FIG. 3 illustrates a waveform of the sensed voltage signal LV with one, two or three lamps open with the LV signal detecting circuit in FIG. 2.

The sensed signal LV typically follows the largest voltage value of all the sensed lamp voltages. As shown in FIG. 3*a* and FIG. 3*b*, the lamp voltage will increase when the lamp is open even without increasing the switching frequency due to increased Q of the resonant circuit. In the case of one, two or three lamps open, the sensed signal LV follows the solid line shown in FIG. 3*c*. When it is higher than Vbias, LV follows the open lamp voltage. When it is lower than Vbias, LV follows the normal operation waveforms (FIG. 3*b*). Therefore, the peak value of the sensed signal LV can be used to regulate the open lamp voltage.

Figure 4:
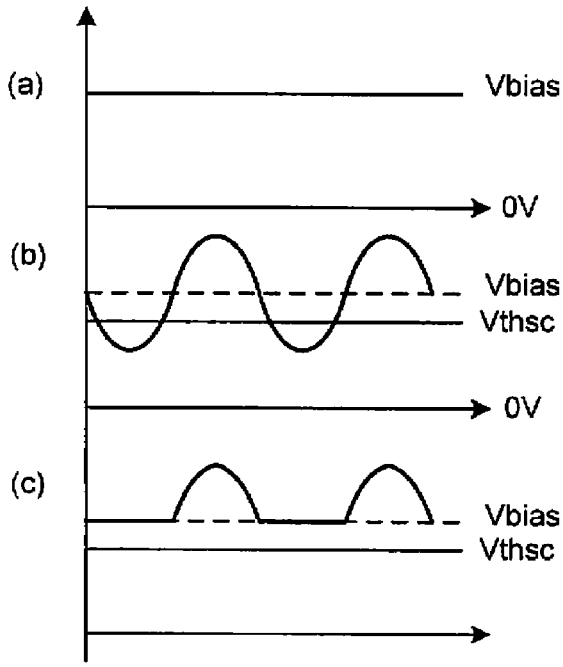
FIG. 4 illustrates a waveform of the sensed voltage signal LV with one, two or three lamps short with the LV signal detecting circuit in FIG. 2.

When all the lamps are shorted, the sensed signal LV is equal to the bias voltage as shown in FIG. 4*a*. The valley of the waveform disappears. In the case of one, two or three lamps being shorted, the sensed signal changes to the waveform with solid line shown in FIG. 4*c*. When the voltage is higher than Vbias, LV follows the normal operation waveform. When the voltage is lower than Vbias, LV follows the shorted lamp voltage, which is equal to Vbias. Therefore, the valley value can be used for lamp short circuit protection.

Figure 5A:
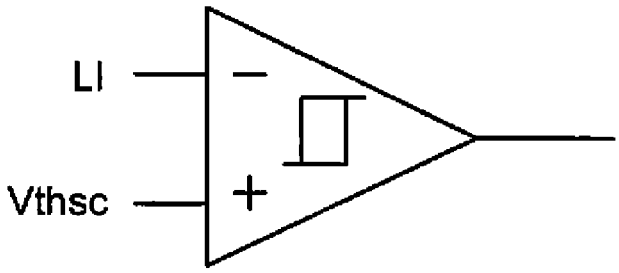
FIG. 5(*a*) is a schematic diagram of a short circuit protection circuit.

The sensed signal LV is compared to a threshold Vthsc, which is in one embodiment is slightly less than Vbias. This is performed by a comparator of FIG. 5*a*. When the waveforms of FIG. 4*b* are input into the comparator of FIG. 5*a*, the comparator will output a pulsed waveform (top waveform of FIG. 5*b*). The pulses correspond to where the sensed voltage LV is greater than the threshold Vthsc. It can be seen that in an alternative embodiment, the comparator can be configured to output a pulse where LV is less than Vthsc. The important element is that where LV crosses Vthsc, a signal is provided.

Figure 5B:
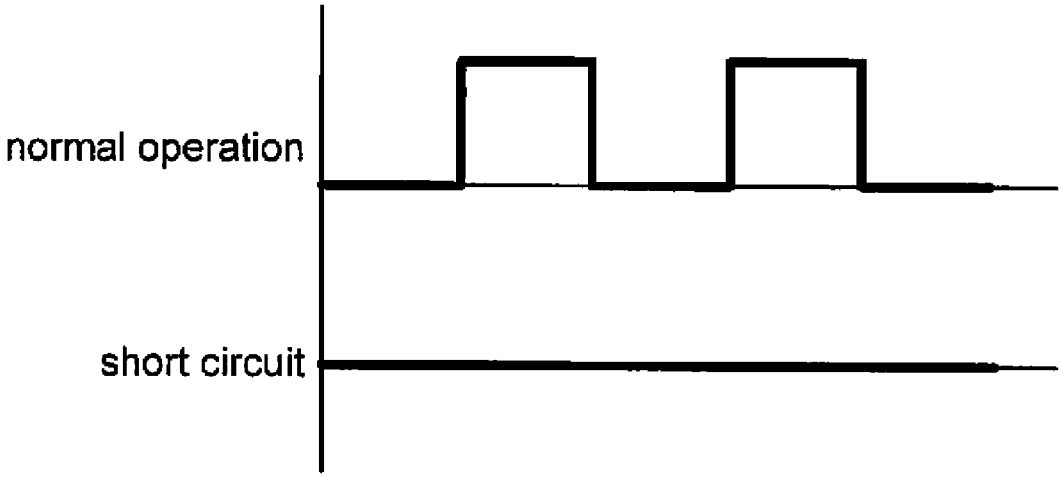

As shown in the upper waveform of FIG. 5*b*, in normal operation, the comparator outputs a pulsed signal. When the pulse is missing, as in the lower waveform of FIG. 5*b*, this is indicative of a short circuit. Under these conditions, short circuit protection can be triggered.

Figure 6:
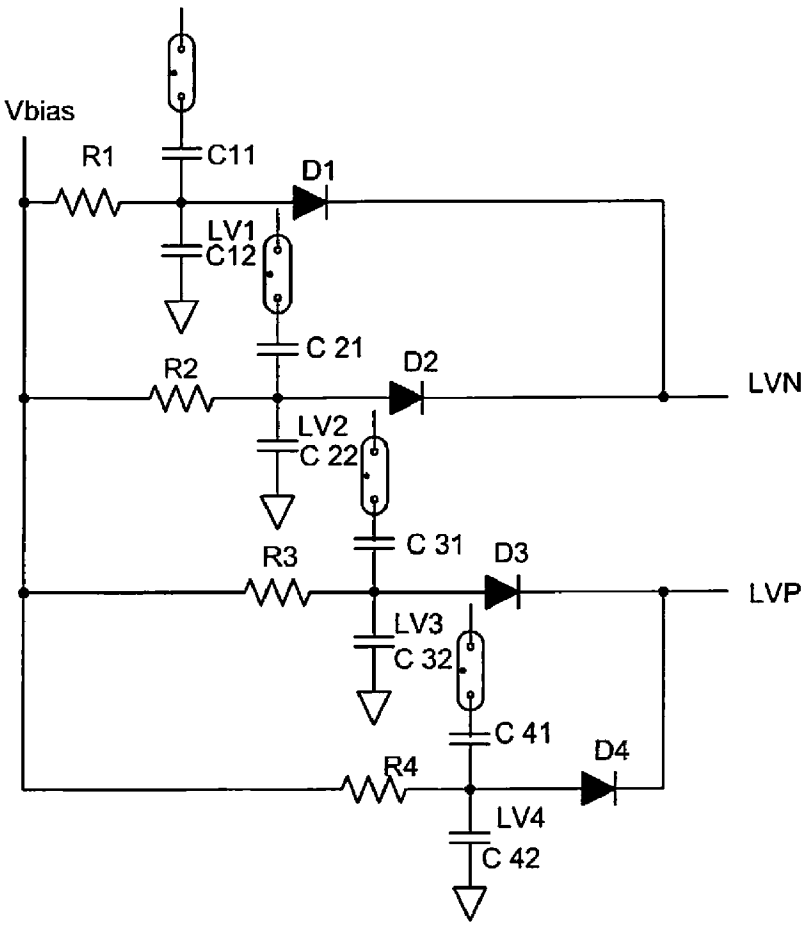
FIG. 6 is a schematic diagram of the LVP and LVN signal detecting circuit for a 4-lamp out-of-phase application in accordance with the present invention.

For out-of-phase applications, the present invention is also applicable. FIG. 6 shows a 4 lamp out-of-phase application according to another embodiment of the present invention. The lamps are divided into two groups, i.e. an in-phase group and an out-of-phase group. For the N-lamp case, N/2 diodes are needed to form an OR logic gate for each group respectively. There are two sensed signals LVP and LVN. The peak value of LVP and LVN is used to regulate the open lamp voltage. LVP and LVN are compared to a threshold by two separate comparators. As above, short circuit protection can be easily detected if the output pulse of any comparator is missing.

Lamp current is another critical parameter for a CCFL controller. Also, lamp current is used for open lamp protection, which is more reliable in practical applications. Conventional CCFL inverters usually use a separate feedback circuit and open lamp protection. The reason for the complexity of the conventional circuit is that only a half cycle or the average of the lamp current is used for feedback.

Figure 7:
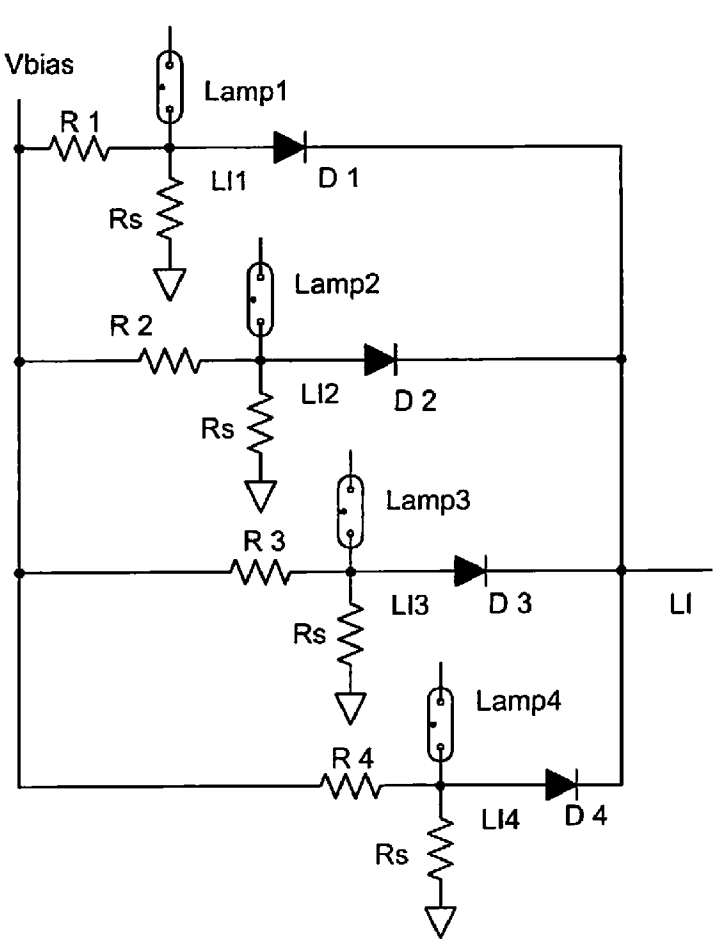
FIG. 7 is a schematic diagram of the LI signal detecting OR gate circuit for a 4-lamp in-phase application in accordance with the present invention.
Figure 10A:
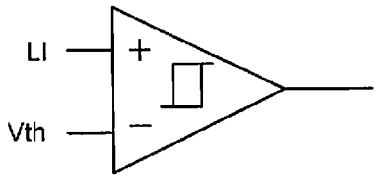
FIG. 10*a* is a schematic diagram of an open lamp protection circuit.
Figure 10B:
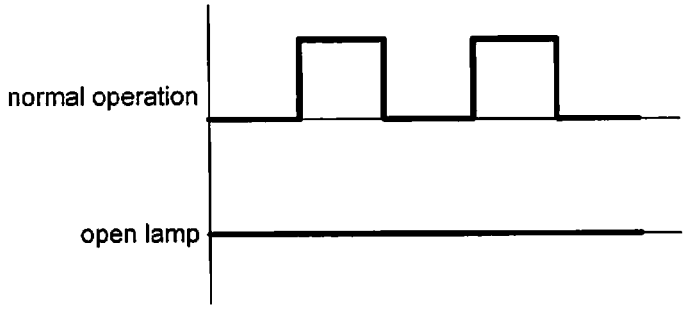
FIG. 10*b* illustrates a waveform of the output of the open lamp protection circuit of FIG. 10*a*.

To combine the feedback circuit and open lamp protection circuit, the solution of using an OR gate and DC bias as described above can also be adopted. A 4-lamp in-phase application is shown in FIG. 7. The operation principle is the same as described above, but the lamp current signal is used instead of the lamp voltage. Specifically, the open lamp can be detected by comparing the LI signal to a threshold Vth using a comparator (FIG. 10). The peak value or RMS value can be used for lamp current regulation.

Figure 8:
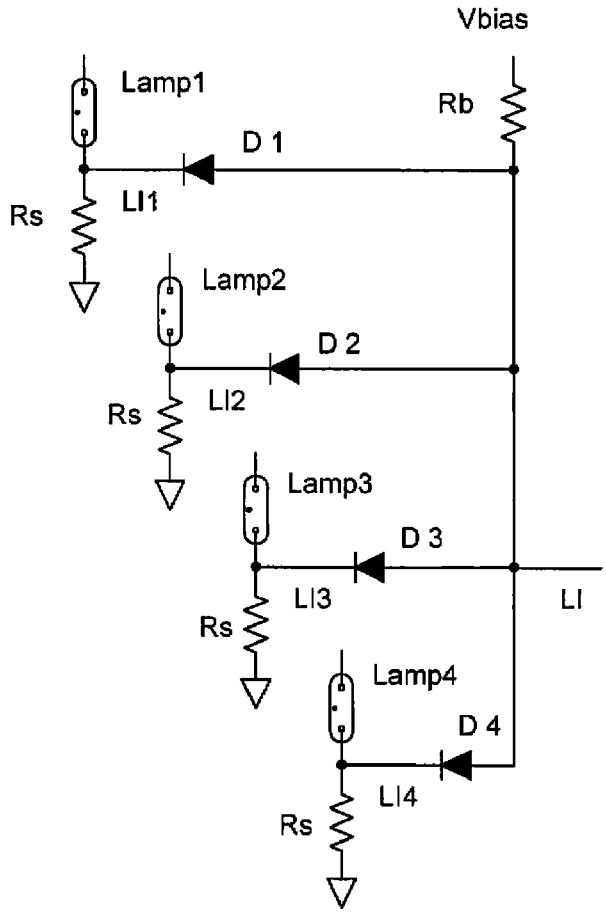
FIG. 8 is a schematic diagram of the LI signal detecting AND gate circuit for a 4-lamp in-phase application in accordance with the present invention.

Another method to combine the feedback and open lamp protection circuit is using an AND gate. In this method, no DC bias voltage is introduced into the lamp current signal. A 4-lamp in-phase application shown in FIG. 8 is used as an example. The sensed LI signal follows the smallest current signal of all the sensed current signals.

Figure 9:
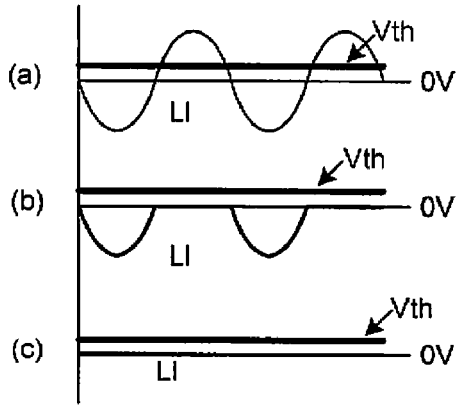
FIG. 9 illustrates a waveform of the sensed current signal LI with one, two or three lamps open with the LI signal detecting circuit in FIG. 8.

In normal operation, the sensed LI signal is an AC signal. The RMS value can be used to regulate the lamp current, which is usually required in practical application. The DC component of the sensed LI signal is almost equal to zero (usually, the pull up resistor Rb is much larger than the current sense resistor Rs as shown in FIG. 8). If one, two or three lamps are open, the positive half cycle of the sensed signal LI will be missing as shown in FIG. 9. Therefore, the positive half cycle can be used for open lamp protection. The sensed signal LI is compared to a relatively small positive threshold. In open lamp condition, the pulse is missing as shown in the lower waveform of FIG. 10.

Figure 11:
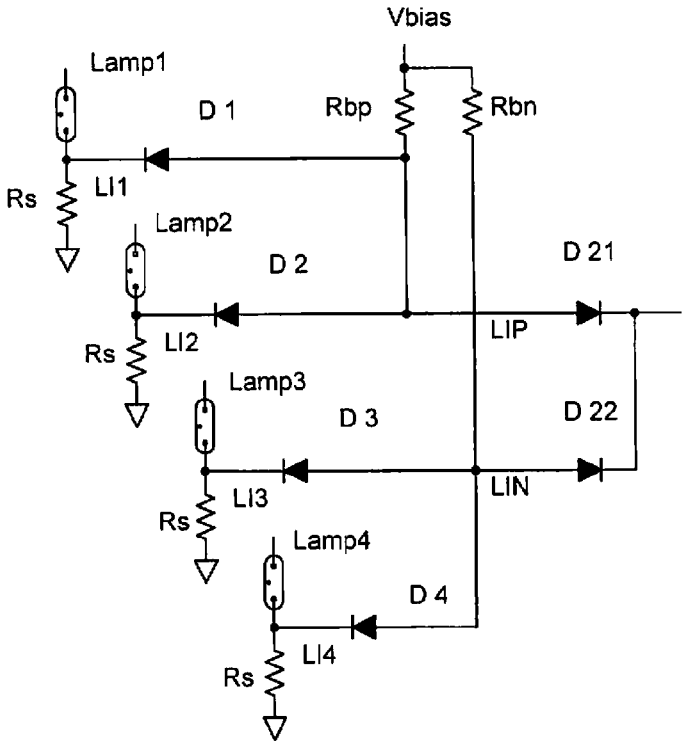
FIG. 11 is a schematic diagram of the LIP and LIN signal detecting circuit for a 4-lamp out-of-phase application in accordance with the present invention.

For out-of-phase applications, the present invention may also be used. The lamp can be divided into two groups, i.e. an in-phase group and an out-of-phase group. For an N lamp case, N/2 diodes are needed to form AND/OR gate for each group respectively. There are two sensed signals LIP and LIN. FIG. 11 shows a 4-lamp out-of-phase application with an AND gate in accordance with another embodiment of the present invention. Two extra diodes D1 and D2 are used as a half-wave rectifier. The RMS value of the signal also combines the RMS value of sensed signal LIP and LIN, which is used for lamp current regulation. Also, LIP and LIN are compared to a threshold by two separate comparators. Open lamp protection can be easily detected if the output pulse of any comparator is missing.

Figure 12:
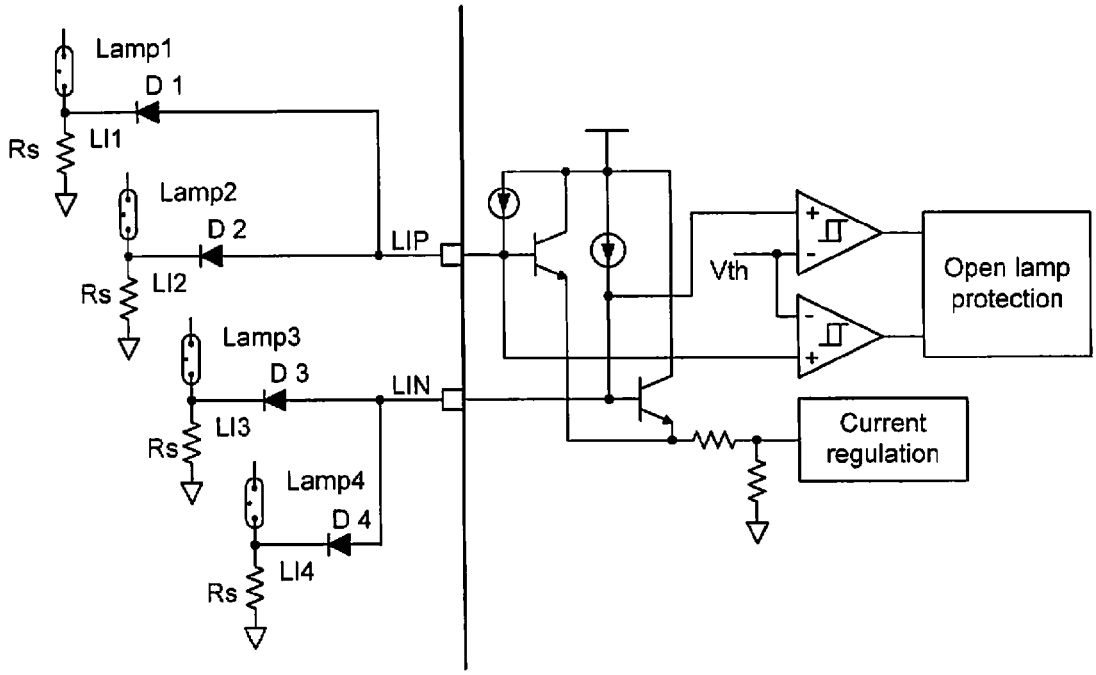
FIG. 12 is a schematic diagram of one of the implementations of the lamp current regulation and open lamp protection circuit in accordance with the present invention.
Figure 13:
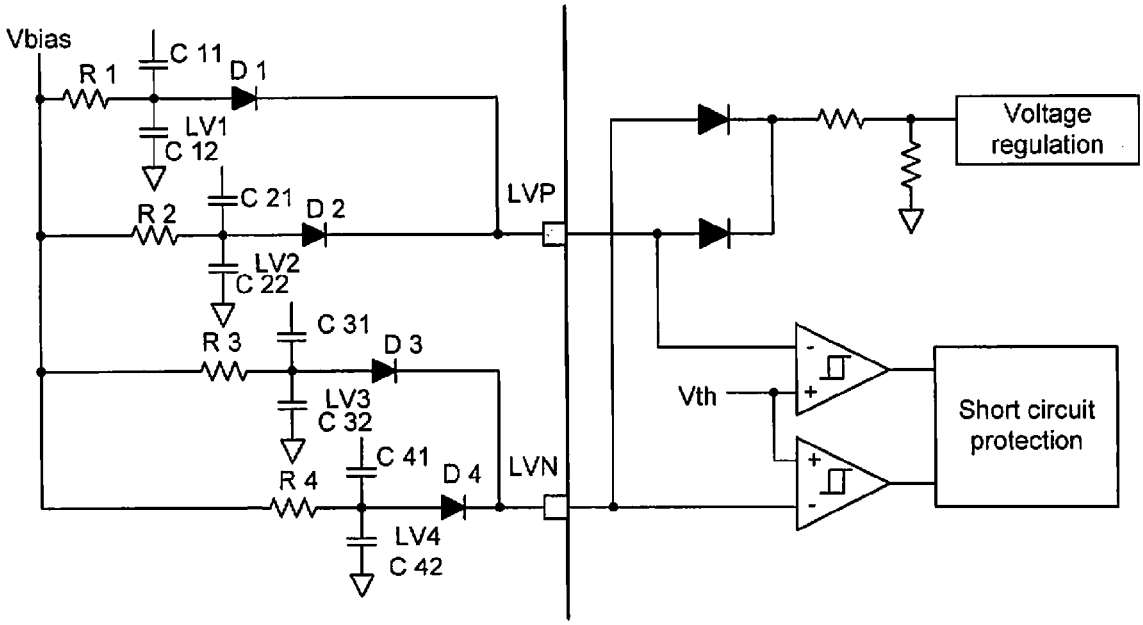
FIG. 13 is a schematic diagram of one of the implementations of the lamp voltage regulation and short circuit protection circuit in accordance with the present invention.

The proposed method can be implemented and integrated into an integrated circuit. FIG. 12 shows one possible implementation associated with an AND gate detector circuit suitable both for out-of-phase and in-phase applications. It also can easily expand to N lamp application by simply using N diodes. For out-of-phase application, the N lamps are divided into two groups according to their phase relationship. For in-phase application, the lamps can be equally divided into 2 groups due to the same phase relationship. FIG. 13 shows one of the implementation of the lamp voltage regulation and short circuit protection with an OR logic gate. Also, it is easy to extent to N lamp applications.

Figure 14:
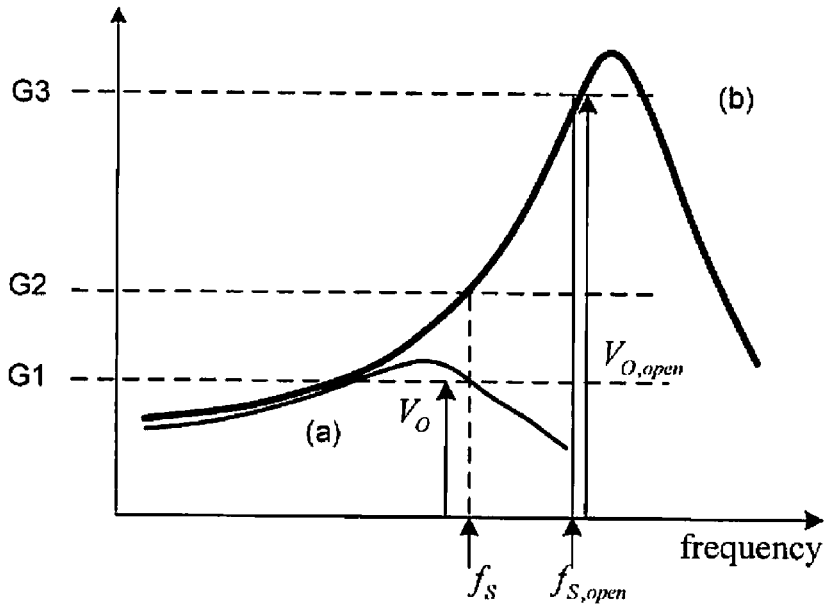
FIG. 14 is the gain curve of a CCFL inverter.

During startup or open lamp condition, a high voltage is usually required to ignite the lamp. The gain curve of the resonant circuit of CCFL inverter at normal condition and open lamp condition is shown in FIG. 14. At normal operation, the switching frequency is fs and the lamp voltage gain is G1. At open lamp condition, if the frequency keeps the same, the gain is G2. Generally, the open lamp voltage should be 2.5~3 times larger than the normal lamp voltage. Therefore, the switching frequency at open lamp condition should increase to a higher value and the lamp voltage gain can be G3.

Figure 15:
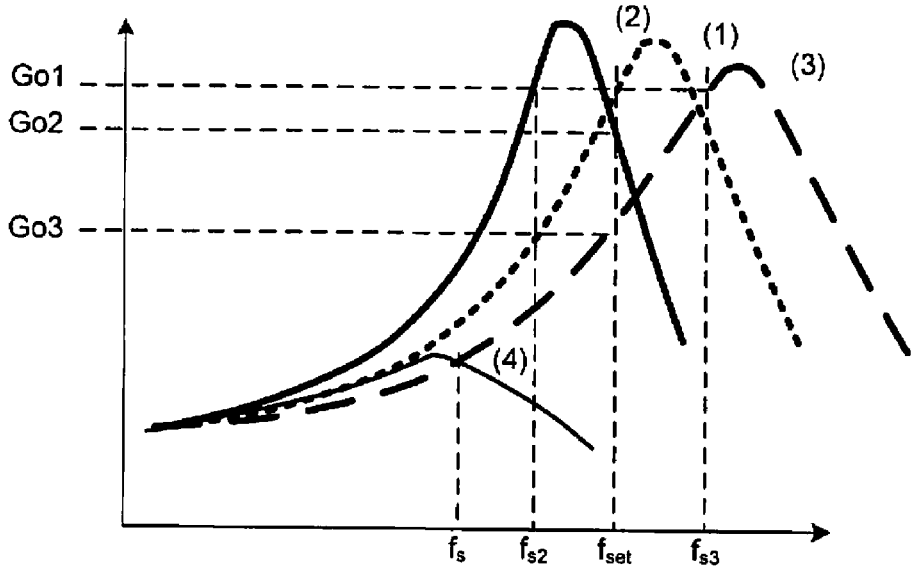
FIG. 15 is the open lamp gain curves with different parasitic parameters.

Generally, the open lamp voltage should be regulated to a certain value to avoid the risk of overstressing the transformer winding and other components. FIG. 15 shows three open lamp gain curves. Gain curve 1 represents the designed open lamp gain curve. The desired gain at open lamp condition is Go1 at designed open lamp switching frequency fset. Nevertheless, the transformer parasitic capacitance and load parasitic capacitance varies between different manufacturers. This significantly affects the gain curve. Furthermore, the resonant inductance and capacitance has a certain tolerance, such as 10% to 20%. With the effect of these parasitic parameters and parameters variation, the actual open lamp gain curve may be gain curve 2 or gain curve 3. Therefore, if the open lamp switching frequency is not adjusted properly, the lamp voltage gain will be lower than the desired one at a certain condition, such as Go2 and Go3 shown in FIG. 15.

Many conventional circuits can implement a frequency sweeping method by using the sensed signal such as LV. Generally, the sensed lamp voltage LV is compared to a reference with an amplifier. A compensation network such as PI is usually required to generate an error signal, which will be referred to as COMP signal hereafter. The COMP signal is used to control the duty cycle to regulate the lamp voltage. If the input voltage varies, the duty cycle also varies to regulate the lamp voltage. Also, if the parasitic parameters of the lamp, transformer, or resonant capacitor changes, the open lamp gain curve will also change. By using the duty cycle control signal COMP to adjust the open lamp frequency, a more flexible frequency sweeping method can be implemented.

Figure 16:
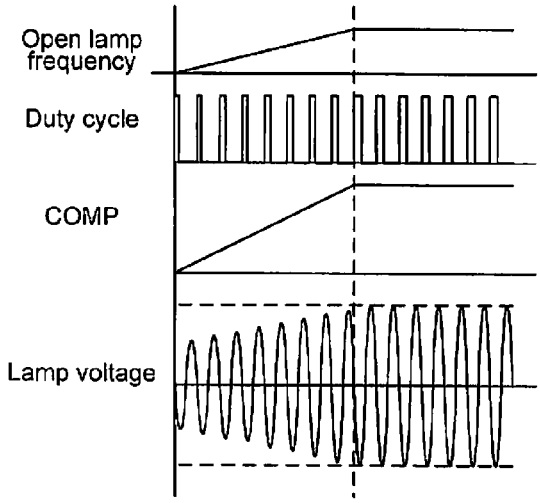
FIG. 16 is the startup waveform with frequency control by COMP in accordance with the present invention.

The startup waveform relating to the frequency sweeping method is shown in FIG. 16. At open lamp condition, the COMP will rise to get the desired open lamp voltage. The open lamp switching frequency will also rise from the normal operating frequency to a higher value according to the COMP voltage. As soon as lamp voltage reaches the desired value (i.e. desired lamp voltage gain), the COMP is regulated to keep the lamp voltage constant. Thus, the switching frequency and duty cycle is also fixed. As shown in FIG. 15, if the open lamp gain curve is changed to gain curve 2 or 3, the circuit can achieve the desired lamp voltage gain. The method offers a simple and reliable open lamp switching frequency setting method.

Figure 17:
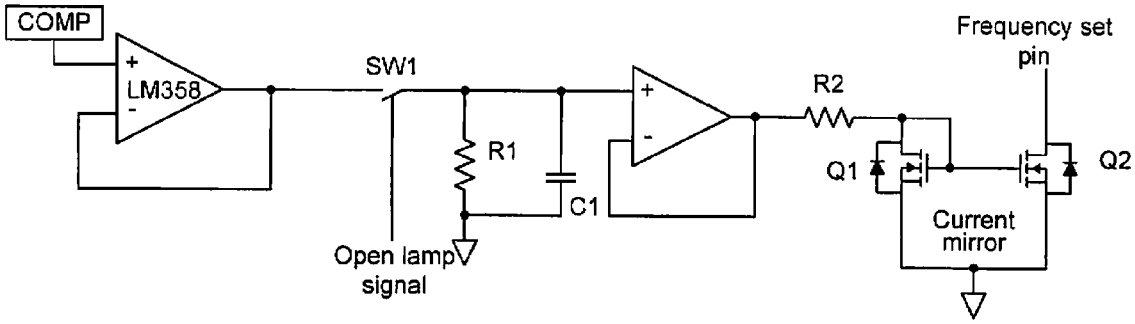
FIG. 17 is a schematic diagram of the adaptive frequency sweeping circuit in accordance with the present invention.

Generally, the normal switching frequency is controlled by a voltage to set the charge/discharge current of oscillator circuit, or control the VCO (Voltage Controlled Oscillator) to achieve the desired frequency. The COMP signal can be simply added to normal frequency set pin to adjust the switching frequency. FIG. 17 shows one of the implementations by adjusting the charge current of the normal frequency set pin as an example. The larger the current drawn from the frequency set pin, the higher the frequency is. As shown in FIG. 17, at open lamp condition, SW1 is conducting and COMP can pass through to adjust the frequency. At normal operation, the frequency is not affected by COMP. C1 and R1 can be integrated to realize slow frequency fold back as soon as open lamp signal is gone (i.e. lamp is ignited), which is useful to eliminate the possible current spike and voltage spike. Various implementation method is possible depend on the normal frequency setting method.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A method for detecting an open lamp condition in a discharge lamp system, comprising:

providing a DC bias voltage to a detector circuit that is coupled to a discharge lamp, said detector circuit having
a sensing resistor coupled to said discharge lamp; and
a diode coupled to said sensing resistor and to said discharge lamp;

deriving a current signal from said detector circuit having said sensing resistor and said diode, said current signal corresponding to a current of said discharge lamp and said DC bias voltage; and if said current signal satisfies an open lamp condition, triggering an open lamp protection process.

2. The method in claim 1, further comprising: coupling said current signal to a protection trigger circuit on an integrated circuit level to trigger the open lamp protection process.

3. The method in claim 1, wherein said current signal is related to a maximum sensing current of said discharge lamp.

4. The method in claim 3, wherein said detector circuit is an OR gate detector circuit.

5. The method in claim 3, wherein the open lamp protection process is triggered when the lowest value of said current signal in one switching cycle is higher than a predetermined threshold voltage.

6. The method in claim 5, wherein said detector circuit is an AND gate detector circuit.

7. The method in claim 5, wherein the open lamp protection process is triggered when the highest value of said current signal in one switching cycle is lower than a threshold voltage.

8. A method for detecting an open lamp or a shorted lamp condition in a discharge lamp system, comprising:

providing a DC bias to a detector circuit that is coupled to a discharge lamp, said detector circuit having
a sensing resistor coupled to said discharge lamp; and
a diode coupled to said sensing resistor and to said discharge lamp;

deriving a current signal from said detector circuit, said current signal corresponding to a current of said discharge lamp and said DC bias voltage;

if said current signal satisfies an open lamp condition, triggering an open lamp protection process; and if said current signal satisfies a shorted lamp condition, triggering a shorted lamp protection process.

9. The method in claim 8, further comprising: coupling said current signal to a protection trigger circuit on an integrated circuit level to trigger the open lamp protection process or the shorted lamp protection process.

10. The method in claim 8, wherein said current signal is related to a maximum sensing current of said discharge lamp.

11. The method in claim 10, wherein said detector circuit is an OR gate detector circuit.

12. The method in claim 10, wherein the open lamp protection process is triggered when the highest value of said current signal in one switching cycle is higher than a first predetermined threshold, and the shorted lamp protection process is triggered when the lowest value of said current signal in one switching cycle is higher than a second predetermined threshold.

13. The method in claim 8, wherein said current signal is related to a minimum sensing current of said discharge lamp.

14. The method in claim 13, wherein said detector circuit is an AND gate detector circuit.

15. The method in claim 13, wherein the open lamp protection process is triggered when the lowest value of said current signal in one switching cycle is lower than a first predetermined threshold, and the shorted lamp protection process is triggered when the highest value of said current signal in one switching cycle is lower than a second predetermined threshold.

16. A circuit for detecting an open lamp condition and triggering an open lamp process in a discharge lamp system, comprising:

a direct current (DC) bias source coupled to at least one discharge lamp, said DC bias source being configured to apply a DC voltage to said at least one discharge lamp;

a detector circuit coupled to said at least one discharge lamp and to said DC bias source; said detector circuit having
a sensing resistor coupled to said at least one discharge lamp; and
a diode coupled to said sensing resistor and to said at least one discharge lamp, said sensing resistor and said diode being configured to output a current signal corresponding to a current of said at least one discharge lamp and said DC bias voltage applied to said at least one discharge lamp; and a protection triggering circuit for receiving said current signal from said detector circuit and triggering the open lamp protection process if said at least one discharge lamp is open.

17. The circuit in claim 16, wherein said circuit is used in connection with a plurality of discharge lamps and said detector circuit is an OR gate detector circuit comprising:

a plurality of sensing resistors coupled to said plurality of discharge lamps wherein one sensing resistor corresponds to one discharge lamp; and a plurality of diodes coupled to said plurality of discharge lamps wherein one diode corresponds to one discharge lamp.

18. The circuit in claim 16, wherein said circuit is used in connection with a plurality of discharge lamps and said detector circuit is an AND gate detector circuit comprising:

a plurality of sensing resistors coupled to said plurality of discharge lamps wherein one sensing resistor corresponds to one discharge lamp;

a plurality of diodes being coupled to said plurality of discharge lamps wherein one diode corresponds to one discharge lamp; and wherein said DC bias source is coupled to said plurality of diodes through a pull-up resistor.

19. The circuit in claim 16, wherein said circuit is used in connection with a plurality of discharge lamps and said detector circuit comprising:

a first plurality of sensing resistors coupled to a first plurality of discharge lamps wherein one of said first plurality of sensing resistors corresponds to one of said first plurality of discharge lamps, voltage of said first plurality of sensing resistors being in phase;

a first plurality of diodes coupled to said first plurality of discharge lamps wherein one of said first plurality of diodes corresponds to one of said first plurality of discharge lamps;

a first additional diode coupled to said first plurality of diodes;

a second plurality of sensing resistors coupled to a second plurality of discharge lamps wherein one of said second plurality of sensing resistors corresponds to one of said second plurality of discharge lamps voltage of said second plurality of sensing resistors being about 180 degree out-of-phase with said first plurality of sensing capacitors;

a second plurality of diodes coupled to said second plurality of discharge lamps wherein one of said second plurality of diodes corresponds to one of said second plurality of discharge lamps;

a second additional diode coupled to said second plurality of diodes; and wherein said DC bias source, is coupled to said first plurality of diodes and said second plurality of diodes.

20. A method for adjusting a switching frequency in a discharge lamp system, comprising:

applying a direct current (DC) bias voltage to a discharge lamp;

deriving a current signal from a detecting circuit coupled to said discharge lamp, said detector circuit having a sensing resistor coupled to said discharge lamp; and a diode coupled to said sensing resistor and to said discharge lamp;

wherein said current signal corresponds to a current of said discharge lamp and to said applied DC bias voltage;

comparing said current signal to a predetermined reference and generating an error signal; and adjusting said switching frequency according to said error signal.

21. The method in claim 20, wherein said current signal is related to a maximum sensing current of said discharge lamp.

22. The method in claim 20, wherein said current signal is related to a minimum sensing current of said discharge lamp.

* * * * *